United States Patent [19]

Miller, Jr. et al.

[11] Patent Number: 4,829,724

[45] Date of Patent: May 16, 1989

[54] CUTTING ABRASIVE FEEDER, DEMAND TYPE

[75] Inventors: Fred W. Miller, Jr., El Cajon; Forrest W. Sweat, Chula Vista; Dale L. Jennings, San Diego, all of Calif.

[73] Assignee: Rohr Industries, Inc., Chula Vista, Calif.

[21] Appl. No.: 142,445

[22] Filed: Jan. 11, 1988

[51] Int. Cl.[4] ..... B24C 7/00

[52] U.S. Cl. ..... 51/436; 51/438; 137/268; 406/151

[58] Field of Search ..... 51/436, 438, 410, 319; 137/892, 268; 222/630; 406/151, 153, 144

[56] References Cited

U.S. PATENT DOCUMENTS

| | | | |
|---|---|---|---|
| 3,344,524 | 10/1967 | Kulishenko | 51/438 |
| 3,345,111 | 10/1967 | Bies et al. | 406/144 |
| 4,381,898 | 5/1983 | Rotolico et al. | 406/144 |
| 4,546,902 | 10/1985 | Anderson | 406/144 |

FOREIGN PATENT DOCUMENTS

| | | | |
|---|---|---|---|
| 0444471 | 5/1927 | Fed. Rep. of Germany | 406/153 |

*Primary Examiner*—Frederick R. Schmidt

*Assistant Examiner*—Robert A. Rose

*Attorney, Agent, or Firm*—Patrick J. Schlesinger; Frank D. Gilliam

[57] ABSTRACT

The invention is directed to an improved hopper for feeding abrasive material of very small grit size to a cutting head. The device comprises an open hopper vertically disposed with a transverse positioned pick-up tube located in the lower portion of the hopper. The pick-up tube has a tubular center with a necked down diameter intermediate of its's ends. An opening extends from the bottom of the tube into the tubular center at a location centered in the necked down portion thereof. One end of the tube is vented to atmosphere through an adjustable orifice and the other end is connected to a source of low pressure created within the mixing chamber of the nozzle body assembly by high pressure water passing across the open end of the tube. This effect causes abrasive grit to be drawn through the opening in the bottom of the tube out the low pressure end of the tube to the cutting head. The flow of abrasive is regulated by controlling inlet/outlet air stream mass air flow or in combination with varying abrasive inlet sizes. The device is a passive, demand system, eliminating the need for mechanically controlled abrasive flow.

10 Claims, 1 Drawing Sheet

CUTTING ABRASIVE FEEDER, DEMAND TYPE

BACKGROUND OF THE INVENTION

1. Field of the Invention

The invention relates generally to grit blast cutting of materials.

2. Description of the Prior Art

The best known prior art is depicted in FIG. 1, a detailed showing of an abrasive feeder type C6015-1 produced by Flow Systems, Inc. of Kent, Wash. The abrasive valve assembly A includes a hopper B, for storing the abrasive grit, a hopper needle valve C for metering grit into the system on demand. The needle valve is seated in seat D when no grit delivery is required at the nozzle. When grit delivery to the nozzle is required the needle valve is caused to translate downwardly by admitting air pressure above the needle valve. With the needle valve displaced from the seat grit is delivered to the nozzle. When flow of grit is to be terminated, the air pressure is removed whereby spring bias, not shown, returns the needle valve upwardly into seat D terminating the flow of grit to the nozzle. This cycle is repeated as grit is supplied to and terminated from the nozzle. The problem with this grit delivery system is that the grit, although generally uniformly sized, includes grit particles of a size larger than the selected grit size and these larger grit particles hang up between the needle valve C and seat D preventing the needle valve from completely seating in its seat when desired grit flow is terminated. This results in grit particles of a size smaller than the selected size being allowed to continue to flow past the needle valve and seat when it is desired to terminate all grit flow to the nozzle. This problem is particularly noticeable when grit particles of an average grit size smaller than 60 grit are used in the system. The clogging of the needle valve results in erratical feeding of the normally smaller sized particles and other related problems.

There has not been a satisfactory means of consistently delivering a uniform supply of grit of a size from 60 to 250 grit until the emergence of the instant invention.

SUMMARY OF THE INVENTION

The present invention comprises a hopper for containing grit particles of a selected size. Although the grit delivery system of this invention is especially directed to the delivery of extremely small grit sizes from 60 grit to 250 grit any desired grit size can be delivered equally as well with this delivery system. A delivery tube is positioned transverse to the opening through the top of the hopper and positioned near the bottom thereof. The delivery tube is hollow with a necked down restricted area centrally positioned intermediate its ends within the hopper. A removable screw with an orifice of a preselected diameter is threaded into a threaded aperture through the lower surface of the delivery tube wall into the necked down restricted area. One end of the delivery tube is connected to a low pressure area associated with the grit delivery path to the nozzle whereby grit particles are drawn from the hopper through the tube aperture when low pressure is present at the end of the delivery tube. The other end of the delivery tube is vented to the atmosphere via an adjustable orifice. The absence of a requirement for a needle valve prevents any particles from being deposited in the system when the low pressure at the end of the delivery tube is removed.

The principle object of the invention is to provide a hopper for a demand grit blasting system which does not clog when used with small grit particle sizes.

Another object of this invention is to provide a hopper for supplying grit to a nozzle on demand which has no moving parts.

Still another object of this invention is to provide a grit hopper with grit flow from the hopper controlled by the inlet/outlet air stream mass flow.

For a further understanding of the invention and further objects, features and advantages thereof, reference may now be had to the following description taken in conjunction with the accompanying drawings.

DETAILED DESCRIPTION OF THE PREFERRED EMBODIMENT

Figure 1:
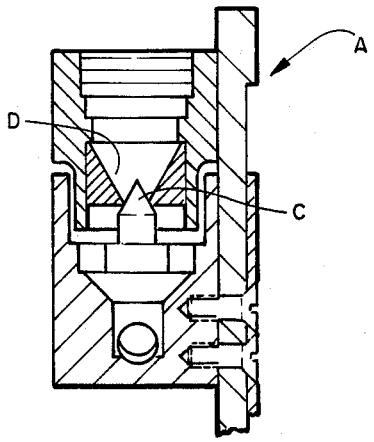
FIG. 1 is a showing of the prior art hopper and grit feed assembly.
Figure 2:
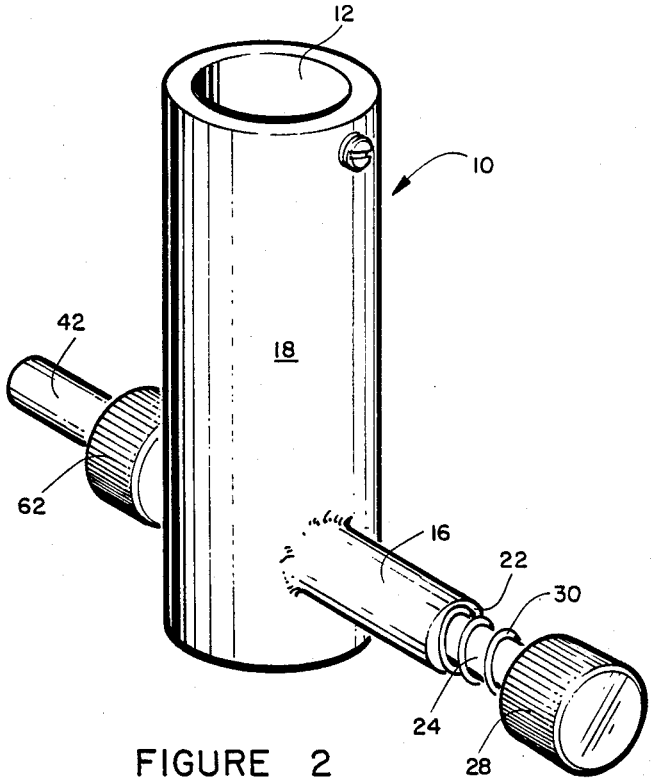
FIG. 2 is an elevated perspective showing of the grit feed hopper of the present invention.
Figure 3:
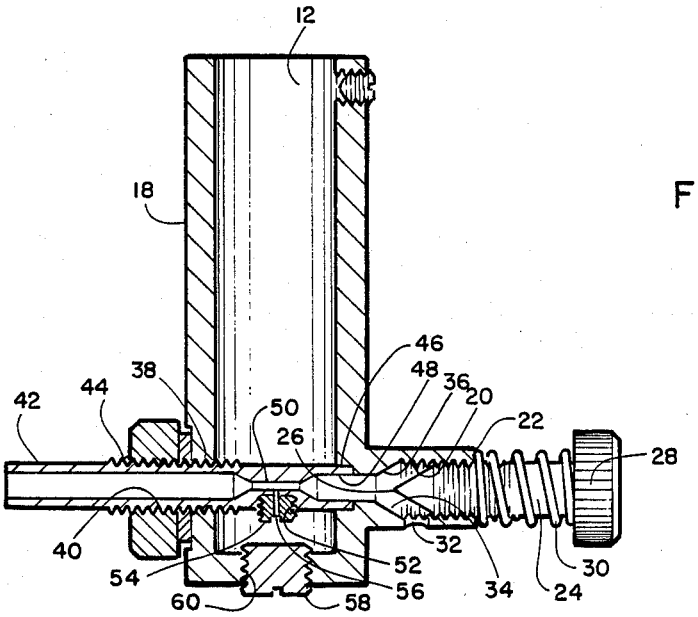
FIG. 3 is a showing taken along line 3—3 of FIG. 2.

Referring specially to FIGS. 2 and 3, the hopper 10 of the invention is shown as cylindrically in cross-section. Although this configuration is preferred it should be understood that the hopper may take other configurations and still be suitable for practical operation of the invention. The hopper 10 has a central opening 12 for receiving and storing abrasive grit particles. Although the hopper and its delivery system is particularly suitable for small grit particle sizes 60 grit size or smaller, substantially any grit size can be delivered with the hopper of the present invention.

Positioned near the bottom surface 14 of the hopper is a tubular protrusion 16 fixedly attached to a side wall 18. The tubular protrusion contains a threaded area 20 extending from the distal end 22 toward the side wall 18. A screw 24 with a needle valve tip 26 and a knurled head 28 is threaded into the threaded area 20. A spring 30 is captured between the knurled head and the distal end 22 of the tubular protrusion to maintain the relative rotational position of screw 24 along threaded area 20. An aperture 32 extends from the lower central surface of the tubular protrusion into the tubular central area 34 of the protrusion adjacent to a valve seat 36 which along with needle valve tip 26 forms a valve.

The wall 18 opposite to the tubular protrusion 16 has a bore 38 therethrough with internal threads 40. A tube 42 with outside threads 44 (male) is threaded into threads 40 and extends into a smooth bore 46 in the side wall 18 adjacent to and aligned with protrusion 16. A central bore 48 in the tube 42 aligns with and forms a continuation with the central area 34 of the protrusion 16. The central bore 48 of the tube 42 has a necked down area 50, generally shaped like a venturi, centrally located within the hopper 10. The bottom most surface of the tube 42 includes a threaded aperture 52 for receiving a plug 54 with a predetermined size aperture 56 therethrough. The selected size of the aperture 56 and the opening through the needle valve determines the maximum quantity of grit material that can be drawn into the central bore of tube 42. The plug 54 with various different sized apertures 56 can be selectively changed for various grit sizes and flow requirements. A drain plug 58 is threaded into a threaded aperture 60 in the bottom of the hopper. This drain plug allows for the changing of plug 54 and the cleaning of the inside of the hopper 10. A knurled lock nut 62 is threaded on threads 44 of tube 42 and tightened against the hopper side wall to hold the tube 42 rigidly in place.

Figure 4:
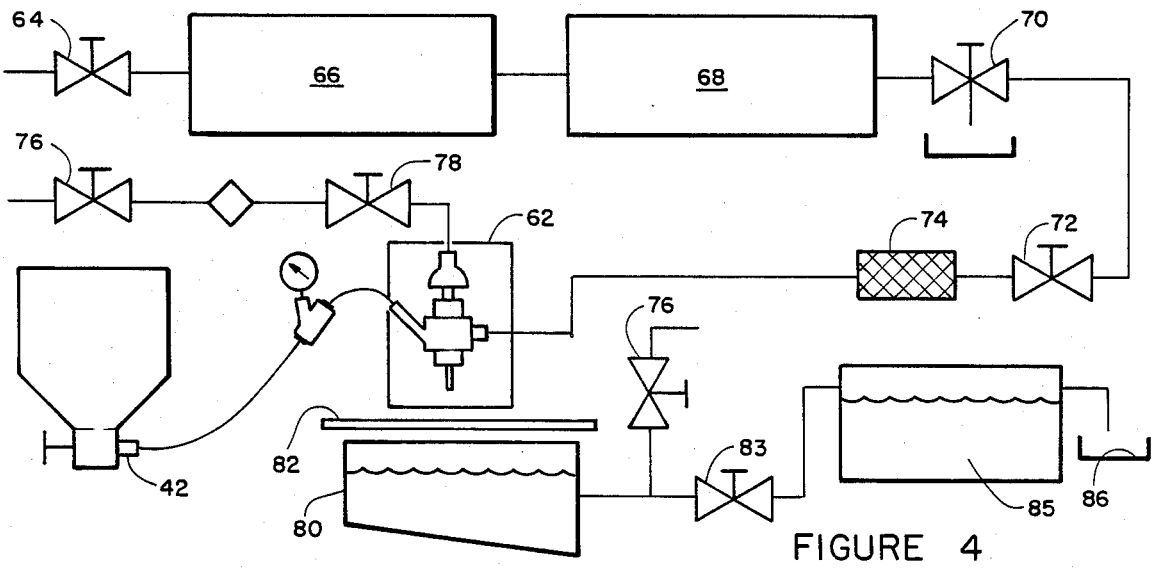
FIG. 4 is a grit blast system employing the improved hopper of the present invention.

Referring now specially to FIG. 4 where a typical operating grit blasting system is shown. A central Nozzle/Body Assembly 62 is shown. The specific type nozzle shown is A Model C6015-1 manufactured by Flow Systems. Water under pressure from a source not shown enters through valve 64, through a water treatment and filtration system 66, well known in the art, to an intensifier pumping unit 68 where the water is pressurized to a high level, through a drain valve 70, through a high pressure water shutoff valve 72, through a line filter 74 and into the nozzle body assembly 62. A lower pressure area or vacuum is created within the nozzle body by the force of the high pressure water passing through the nozzle assembly. The creation of the a low pressure with the nozzle is well known in the art and, is therefore, no further discussion will be included herein. A connection to tube 42 supplies this created vacuum at aperture 56. Shop compressed air is supplied from a compressor, not shown, through a shutoff valve 76 and a control valve 78 to the nozzle body assembly 62. A catcher tank 80 positioned below a work piece 82 being grit blasted catches the used water and grit residue which is forced by shop air through valve 83 into a sand trap 85 where the grit is collected and the liquid flows down a convenient drain 86.

The grit flow from the hopper is absolutely controlled by regulating the air flow through the feeder abrasive pick-up tube using the needle valve 28; air flow is induced by the low pressure or vacuum created within the nozzle body assembly mixing chamber 62, where abrasive grit is mixed with water under pressure.

The foregoing disclosure and the showings made in the drawings are merely illustrative of the principals of the invention and are not to be interpreted in a limiting sense.

What is claimed is:

1. An improved abrasive grit feed hopper for use in combination with a delivery nozzle comprising:

means for creating a low pressure area within said nozzle;

an abrasive grit storage compartment having a bottom surface for containing abrasive grit of a selected size;

a hollow delivery tube within said storage compartment positioned substantially parallel to said bottom surface, one end of said delivery tube vented through a vent orifice open to the atmosphere and the other end open for connection to said low pressure area, said delivery tube having an abrasive grit input opening through the surface thereof adjacent to said bottom surface and extending into the hollow center thereof; and a removable plug which mates with the opening through the lower surface, said abrasive grit opening in said delivery tube being formed through said removable plug.

2. The invention as defined in claim 1 wherein said vent orifice comprises means for adjusting the orifice cross sectional area.

3. An improved abrasive grit feed hopper for use in combination with a delivery nozzle comprising:

means for creating a low pressure area within a nozzle;

an abrasive delivery tube within said storage compartment positioned substantially parallel to said bottom surface, one end of said delivery tube vented through a vent orifice open to the atmosphere and the other end open for connection to said low pressure area, said vent orifice comprises means for adjusting the orifice cross sectional area, said means for adjusting air flow said orifice cross sectional area comprises a position translatable needle valve tip, a mating valve seat and a biasing means for maintaining said needle valve tip in a selected position relative to said mating tip, said delivery tube having an abrasive grit input opening through the surface thereof adjacent to said bottom surface and extending into the hollow center thereof.

4. The invention as defined in claim 1 wherein said hollow portion of said delivery tube is necked down adjacent to said opening.

5. The invention as defined in claim 1 wherein said abrasive grit opening is selected in cross-sectional area in accordance with the size of abrasive grit in said container.

6. The invention as defined in claim 1 wherein grit sizes finer than 60 grit can be dispensed from said hopper through said abrasive grit opening.

7. The invention as defined in claim 3 wherein said abrasive grit opening in said delivery tube is formed through a removable plug which mates with the opening through the lower surface.

8. The invention as defined in claim 3 wherein said hollow portion of said delivery tube is necked down adjacent to said opening.

9. The invention as defined in claim 3 wherein said abrasive grit opening is selected in cross sectional area in accordance with the size of the abrasive grit in said container.

10. The invention as defined in claim 3 wherein grit sizes finer than 60 grit can be dispensed from said hopper through said abrasive grit opening.

* * * * *